US008950606B2

(12) United States Patent
Dunham

(10) Patent No.: US 8,950,606 B2
(45) Date of Patent: Feb. 10, 2015

(54) SELF-CONTAINED MODEL RAILROAD COUPLER

(75) Inventor: Michael Nathan Dunham, Central Point, OR (US)

(73) Assignee: Kadee Quality Products Co., White City, OR (US)

( * ) Notice: Subject to any disclaimer, the term of this patent is extended or adjusted under 35 U.S.C. 154(b) by 24 days.

(21) Appl. No.: 13/535,077

(22) Filed: Jun. 27, 2012

(65) Prior Publication Data

US 2014/0001141 A1 Jan. 2, 2014

(51) Int. Cl.
*A63H 19/18* (2006.01)

(52) U.S. Cl.
USPC ..... 213/75 TC

(58) Field of Classification Search
CPC ..... A63H 19/18
USPC ..... 213/75 TC
See application file for complete search history.

(56) References Cited

U.S. PATENT DOCUMENTS 3,939,989 A * 2/1976 Thomson ..... 213/75 TC
5,316,158 A 5/1994 Dunham et al.
5,775,524 A 7/1998 Dunham
7,659,834 B2 * 2/2010 Young et al. ..... 340/12.51
7,775,385 B2 * 8/2010 Dudley ..... 213/75 TC
7,810,660 B1 10/2010 Dunham
2005/0126838 A1 * 6/2005 Vaughan ..... 180/167
2008/0110845 A1 * 5/2008 Edwards et al. ..... 213/75 R

OTHER PUBLICATIONS

"HO Operating Couplers," M.T.H. Electric Trains, http://www.mthtrains.com/news/393, Feb. 4, 2009, 2 pages.
Lionel J Class and B&A Tender Electrocoupler Kit (Product No. 6-22955), Lionel Corporation, Jul. 1998, 6 pages.

* cited by examiner

*Primary Examiner* — Zachary Kuhfuss
(74) *Attorney, Agent, or Firm* — Alleman Hall McCoy Russell & Tuttle LLP

(57) ABSTRACT

Embodiments related to a self-contained coupler for model railroad rolling stock are provided. In one example, a self-contained coupler comprises a coupler assembly including a knuckle and an uncoupling assembly configured to operate the coupler assembly. The example uncoupling assembly includes a signal input for receiving a signal and a motivator coupled to the coupler assembly via a movable link, the motivator operative to adjust the knuckle from a first position to a second position responsive to the signal. The example uncoupling assembly also includes a housing including the motivator and a rolling stock mounting location for mounting the uncoupling assembly to an item of the model railroad rolling stock.

21 Claims, 8 Drawing Sheets

SELF-CONTAINED MODEL RAILROAD COUPLER

BACKGROUND

Some people enjoy modeling the day-to-day operational activities of railroads, assembling trains of rolling stock and moving them through a model landscape. However, it can be challenging to replicate some train operations and train appearance because of the size differences between the model and reality. For example, it can be difficult to replicate uncoupling and removing rail cars from a model train. Some past approaches rely on manually manipulating a rail car to uncouple it form a train, but such action may damage the car. Some other past approaches rely on the interaction of a model coupler with an uncoupling device mounted to the model railroad track. However, these approaches may limit where a rail car may be uncoupled and the appearance of the train, potentially limiting the user's enjoyment of modeling prototypical railroad activities and objects.

SUMMARY

Various embodiments are disclosed herein that relate to a self-contained coupler for model railroad rolling stock. For example, one embodiment provides a self-contained coupler comprising a coupler assembly including a knuckle and an uncoupling assembly configured to operate the coupler assembly. The example uncoupling assembly includes a signal input for receiving a signal and a motivator coupled to the coupler assembly via a movable link, the motivator operative to adjust the knuckle from a first position to a second position responsive to the signal. The example uncoupling assembly also includes a housing including the motivator and a rolling stock mounting location for mounting the uncoupling assembly to an item of the model railroad rolling stock.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
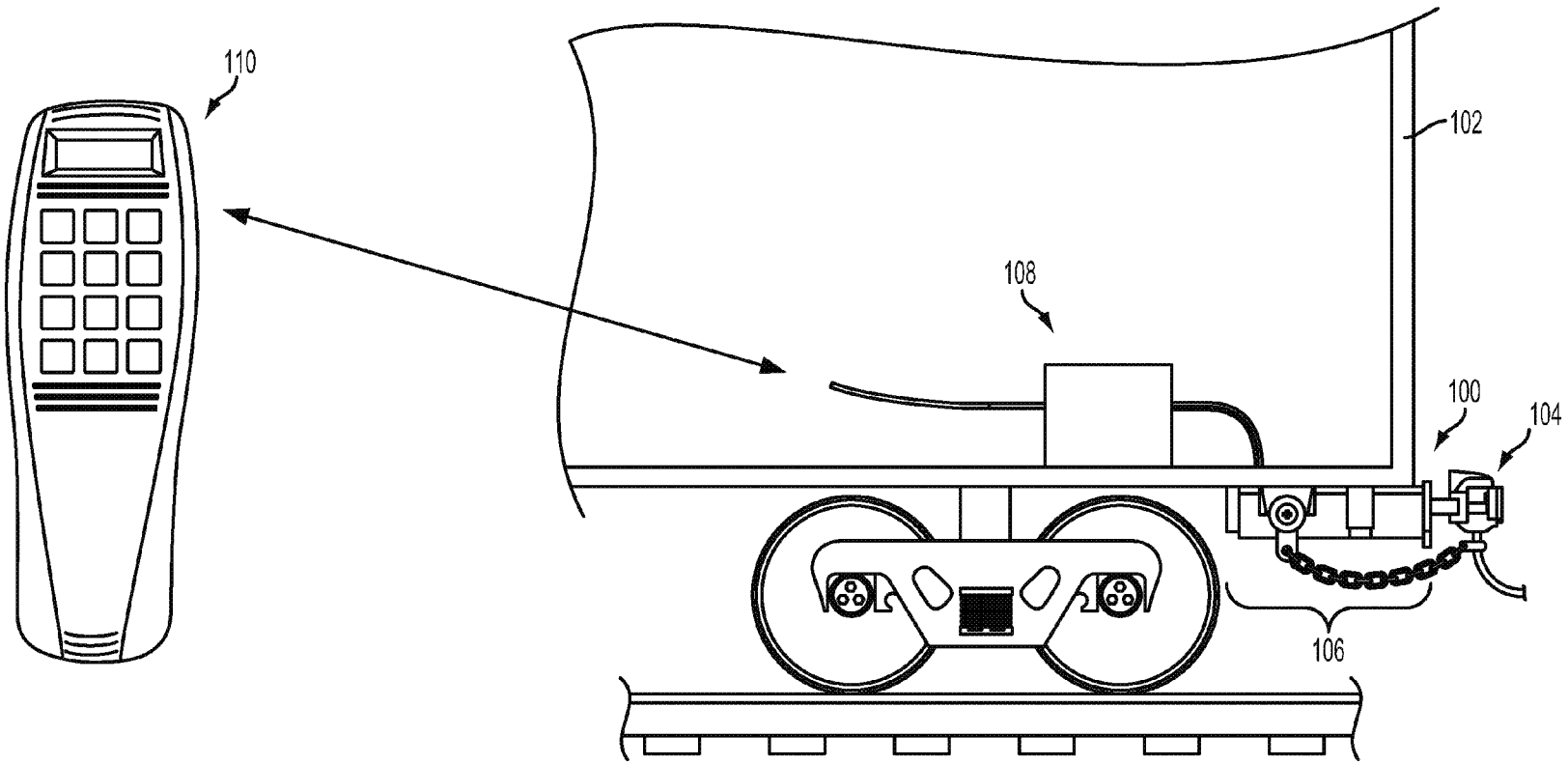
FIG. 1 schematically illustrates a self-contained coupler mounted to an item of model railroad rolling stock according to an embodiment of the present disclosure.

Many hobbyists build models of trains and the railroads on which those trains run. Some people take pleasure in achieving, with great fidelity, models of the rolling stock (e.g., rail cars and locomotives) used on railroads in the present or at some point in history. Some people enjoy modeling the day-to-day operational activities of railroads, assembling trains of rolling stock and moving them through a model landscape. Regardless of the source of enjoyment that a modeler may find in the hobby, at some point the hobbyist may confront the interface of the model world with the non-model world, whether it is the abrupt end of a modeled sky or the difficulty of simulating the behavior of large, heavy equipment in a smaller model.

For example, modeling railroad operations can be difficult. As businesses, railroads move passengers and/or freight between locations. In some settings, a railroad may assemble a train of rail cars in one city to be hauled to another city, picking up and dropping off rail cars en route. Adding a rail car to a train may be managed by railroad personnel working on the ground near the train to operate the couplers that connect the rail car to the train, to connect the air brake hoses, and so on. However, it can be challenging to replicate these physical activities because of the size differences between the model train and the train on which it is modeled. For example, one common model railroading scale represents approximately 87 scale feet in one U.S. foot. In such settings, it can be difficult to fit a finger between coupled rolling stock, potentially making uncoupling operations difficult.

One approach to uncoupling cars involves lifting one of the coupled cars so that the cars are uncoupled by vertical separation of the couplers. However, this approach may harm delicate details on the rolling stock and/or may derail the train. Another approach involves inserting a tool into the locked couplers to wrench them apart. However, this approach may also derail the train. Moreover, both of these manual uncoupling approaches require that the operator be able to physically access the coupler to perform the uncoupling action. Some model locomotives may be equipped with automatic couplers so that the locomotive may be coupled and uncoupled from a train. However, being locomotive-equipped, such devices may not allow rail cars to be uncoupled from one another, potentially diminishing the user experience. Moreover, because such devices may be built-in to the locomotive and be powered by the locomotive, it may be difficult for the modeler to equip other locomotives with interoperable couplers. In turn, the modeler may face difficult decisions about how to integrate a locomotive so-equipped into an existing fleet.

Accordingly, the embodiments disclosed herein are related to a self-contained coupler for model railroad rolling stock. In one example, a self-contained coupler comprises a coupler assembly including a knuckle and an uncoupling assembly configured to operate the coupler assembly. The example uncoupling assembly includes a signal input for receiving a signal and a motivator coupled to the coupler assembly via a movable link, the motivator operative to adjust the knuckle from a first position to a second position responsive to the signal. The example uncoupling assembly also includes a housing including the motivator and a rolling stock mounting location for mounting the uncoupling assembly to an item of the model railroad rolling stock.

The embodiments disclosed herein are also related to a self-contained coupler kit for retrofitting an uncoupling mechanism to model railroad rolling stock. In one example, the self-contained coupler kit comprises a coupler assembly including a knuckle and an uncoupling assembly. The example uncoupling assembly includes a signal input, a motivator operative to adjust the knuckle from a first position to a second position, and a housing including the motivator, a rolling stock mounting location for mounting the self-contained coupler kit to an item of model railroad rolling stock, and a coupler attachment location for pivotally mounting the coupler assembly to the uncoupling assembly between the motivator and the knuckle.

The embodiments disclosed herein are also related to a model railroad rolling stock coupling/uncoupling system. In one example, the model railroad rolling stock coupling/uncoupling system comprises a rolling stock wireless communicator configured to receive wireless communication and a coupler in operative communication with the rolling stock wireless communicator. The example coupler includes a coupler assembly and an uncoupling assembly including a motivator coupled to the coupler assembly via a movable link, the motivator operative to adjust the coupler assembly from a first position to a second position responsive to a signal received from the rolling stock wireless communicator.

FIG. 1 schematically illustrates an embodiment of a self-contained coupler 100 mounted to an item of model railroad rolling stock 102. In the example shown in FIG. 1, the item of model railroad rolling stock 102 is depicted as a rail car, but it will be appreciated that self-contained coupler 100 could be mounted to a locomotive or any suitable rolling stock without departing from the scope of the present disclosure. Additional information about model railroad rolling stock may be found in U.S. Pat. No. 5,775,524 to Dunham, the entirety of which is incorporated by reference for all purposes. As shown in FIG. 1, self-contained coupler 100 includes a coupler assembly 104 configured to couple with and uncouple from a compatible coupler assembly (not shown). Coupler assembly 104 is configured to be operated by uncoupling assembly 106, as described in more detail below.

In the embodiment shown in FIG. 1, a rolling stock wireless communicator 108 electronically communicates with uncoupling assembly 106. Rolling stock wireless communicator 108 wirelessly communicates with a signal source 110 to provide signals causing uncoupling assembly 106 to operate coupler assembly 104. In turn, rolling stock 102 may be uncoupled from other rolling stock responsive to wireless commands.

Figure 2:
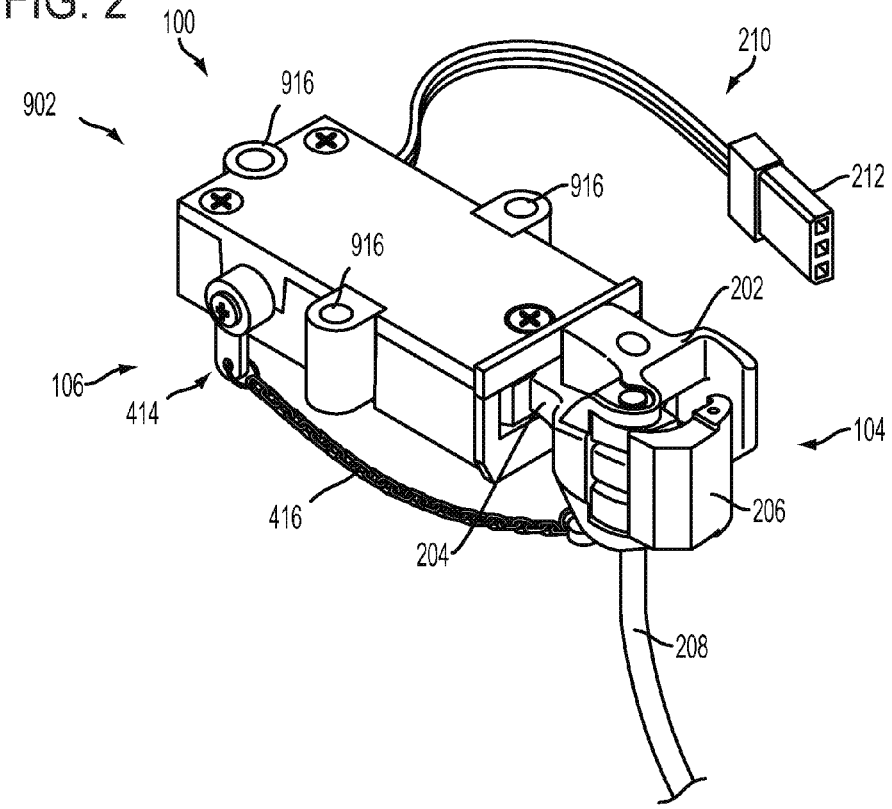
FIG. 2 illustrates a top perspective of an example self-contained coupler according to an embodiment of the present disclosure.
Figure 3:
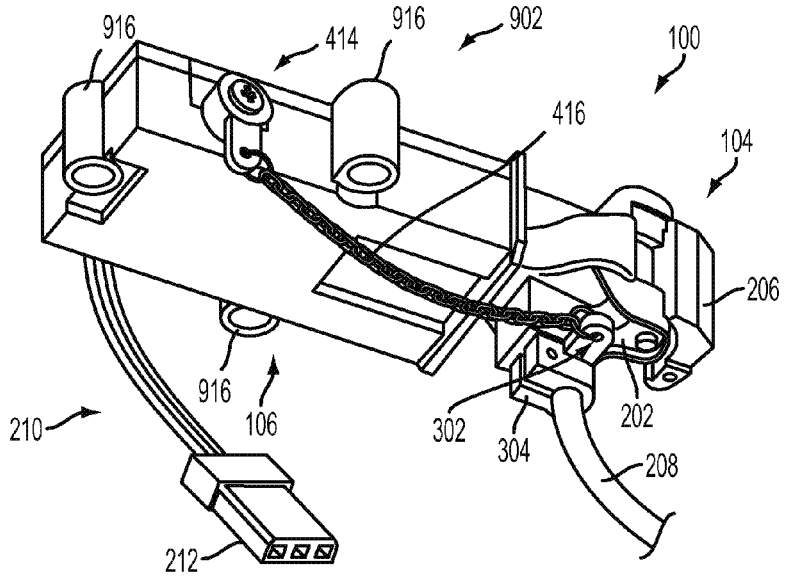
FIG. 3 illustrates a bottom perspective of an example self-contained coupler according to an embodiment of the present disclosure.

FIGS. 2 and 3 illustrate top and bottom perspectives of examples of self-contained coupler 100. For example, the examples shown in FIGS. 2 and 3 may be mounted to an item of rolling stock as shown in FIG. 1. In the embodiments shown in FIGS. 2 and 3, coupler assembly 104 is a knuckle coupler that includes a coupler head 202 extending from a shank 204 and a knuckle 206 that is pivotally mounted to coupler head 202 via a trip pin 208.

In some embodiments, trip pin 208 may participate in an uncoupling action motivated by uncoupling assembly 106. For example, FIG. 3 shows an attachment location 302 coupled to trip pin 208 via a connector 304. When the depicted embodiment is in use, attachment location 302 is configured to receive a pulling motion transmitted from uncoupling assembly 106. As attachment location 302 is offset from connector 304, the motion causes trip pin 208 to rotate and move knuckle 206 into an open, "uncoupled" position. When the pulling motion is removed, knuckle 206 returns to a closed, "coupled" position (even if not coupled to another item of rolling stock) in response to a biasing spring (not shown) included in the coupler assembly.

In some embodiments, trip pin 208 may also allow coupler assembly 104 to be uncoupled using magnetic and/or mechanical uncoupling devices. For example, in some embodiments, trip pin 208 may be magnetically-sensitive, so that a suitable magnetic field causes knuckle 206 to pivot about trip pin 208 into an uncoupled position. As another example, trip pin 208 may be configured to interact with a railroad track-mounted uncoupling ramp, so that mechanical interaction with the ramp causes an uncoupling action. While the examples of trip pin 208 shown in FIGS. 2 and 3 are illustrated as curved members that might evoke the appearance of a railroad air brake hose, it will be appreciated that any suitably shaped trip pin 208 may be employed without departing from the scope of the present disclosure.

FIGS. 2 and 3 also show a signal input 210 included in uncoupling assembly 106. Signal input 210 is configured to receive a signal from rolling stock wireless communicator 108. It will be appreciated that any suitable signal input 210 may be employed without departing from the scope of the present disclosure. In the embodiments depicted in FIGS. 2 and 3, signal input 210 includes an electrical connector 212 that provides a plug-in connection between signal input 210 and rolling stock wireless communicator 108.

As shown in FIGS. 2 and 3, self-contained coupler 100 comprises coupler assembly 104 configured to couple with a suitably complementary coupler. In the example shown in FIGS. 2 and 3, coupler assembly 104 includes knuckle 206 having a pulling face hinged with coupler head 202, but it will be appreciated that any other suitable pulling face configured to move from a first position to a second position and, in turn, cause a coupling or uncoupling event, may be employed without departing from the scope of the present disclosure.

Further, in the examples shown in FIGS. 2 and 3, uncoupling assembly 106 is configured to operate coupler assembly 104 by adjusting knuckle 206 or any other suitable portion of coupler assembly 104, such as coupler head 202, a trip pin, a pivot, or a hinge, from a first position to a second position using a motivator 414, such as by pushing or pulling on a portion of the coupler via movable link 416. As explained in more detail below, motivator 414 may include any suitable manner of generating a motivating force for making the coupler adjustment. Non-limiting examples include servos, solenoids, motors and gearboxes, NiTi memory wires, and so on. Further, movable link 416 may include any suitable link for transmitting the force generated at motivator 414 to coupler assembly 104, such as rigid or flexible links that may or may not be length-adjustable.

Further, in the examples shown in FIGS. 2 and 3, uncoupling assembly 106 comprises a housing 902 that includes one or more rolling stock mounting locations 916 for mounting the uncoupling assembly to an item of the model railroad rolling stock. As described in more detail below, rolling stock mounting locations 916 are configured to removably or permanently affix self-contained coupler 100 to an item of rolling stock. In some embodiments, signal input 210 may be fully or partially enclosed by housing 902. For example, signal input 210 may include a wireless receiver enclosed by housing 902. In some embodiments, signal input 210 may include a plug integrated into housing 902.

Figure 4:
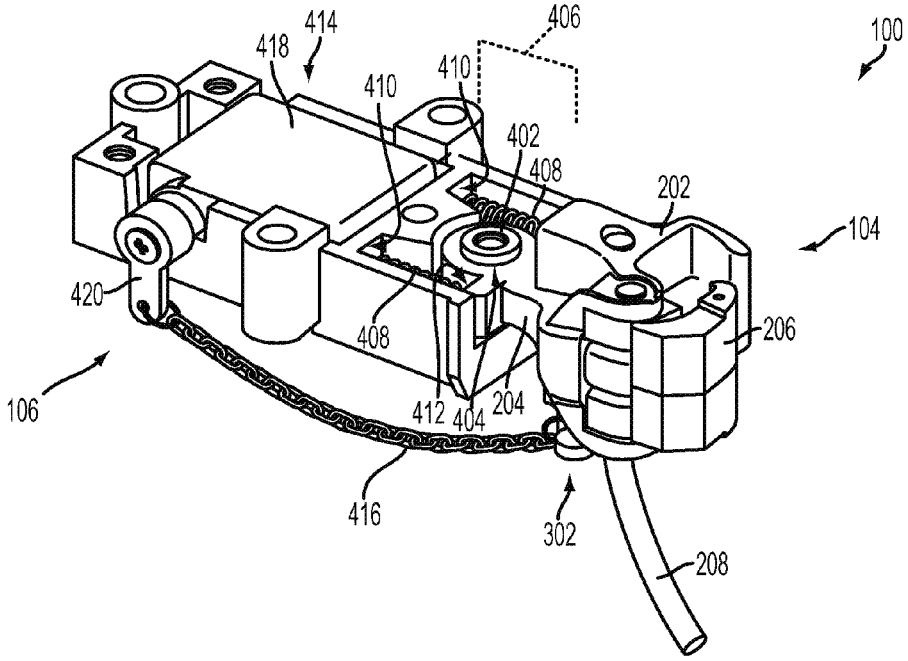
FIG. 4 illustrates an interior portion of an example self-contained coupler according to an embodiment of the present disclosure.

Coupling assembly 104 is attached to uncoupling assembly 106 at one or more suitable coupler attachment locations. In some embodiments, a coupler attachment location may include one or more suitable structures configured to secure, temporarily or permanently, coupling assembly 104 to uncoupling assembly 106. In some embodiments, such structures may permit movement of coupling assembly 104 relative to uncoupling assembly 106. For example, in some embodiments, coupling assembly 104 may be pivotally mounted to uncoupling assembly 106. FIG. 4 illustrates an interior portion an example of self-contained coupler 100. In the embodiment shown in FIG. 4, uncoupling assembly 106 includes a coupler attachment location 402 configured to permit coupling assembly 104 to be pivotally mounted to uncoupling assembly 106. In the embodiment shown in FIG. 4, coupler attachment location 402 includes a coupler pivot pin 403. In the embodiment shown in FIG. 4, coupler assembly 104 is retained at coupler attachment location 402 by an opening 404 formed into shank 204 into which coupler pivot pin 403 is fitted. In turn, coupler assembly 104 may pivot about coupler attachment location 402. Pivotally mounting coupler assembly 104 permits coupler assembly 104 to swing laterally. This may ease the movement of rolling stock around curves and avoid undesired uncoupling. In some other embodiments, coupling assembly 104 may be mounted to uncoupling assembly 106 about a structure that provides vertical and lateral movement (e.g., a ball and socket joint) included at coupler attachment location 402, potentially providing additional play within the coupler. In still other embodiments, coupling assembly 104 may be fixed in a preselected position relative to uncoupling assembly 106 at coupler attachment location 402.

In some embodiments, a coupler centering mechanism may be included in self-contained coupler 100. Inclusion of a coupler centering mechanism may allow the coupler to self-center (with respect to a centerline of the rolling stock) in a lateral direction so that a pair of couplers on different items of rolling stock may be properly self-aligned and centered prior to coupling the rolling stock. Any suitable mechanism for allowing coupler assembly 104 to laterally swing and then return to a preselected center position may be employed without departing from the scope of the present disclosure. For example, the embodiment shown in FIG. 4 depicts a coupler centering mechanism 406 comprising a pair of centering springs 408 positioned on either side of shank 204. The embodiment of coupler centering mechanism 406 shown in FIG. 4 also includes a pair of bias surfaces that receive pressure from each centering spring 408, so that, in a static mode, coupler assembly 104 is centered by balanced, opposing action of each centering spring 408. As shown in FIG. 4, each centering spring 408 extends between a bias surface 410 on uncoupling assembly 106 and another bias surface 412 included in coupler assembly 104.

As introduced above, uncoupling assembly 106 includes motivator 414 which generates motion for transmission to coupler assembly 104 via movable link 416 to cause knuckle 206 to move from a first position to a second position. In the embodiment shown in FIG. 4, motivator 414 includes a servo 418 operative to cause member 420 to move, pulling movable link 416. In turn, movable link 416 causes knuckle 206 to change positions as described above. Separating motivator 414 from knuckle 206 by movable link 416 may allow coupler assembly 104 to swing and move during train operation while uncoupling assembly 106 is securely mounted to the rolling stock. Moreover, the inclusion of movable link 416 may protect motivator 414 from damage that may result from slack action during train operation. For example, slack action may cause rapid reversals in drawbar forces to be transmitted through knuckle 206, coupler head 202, and shank 204. Direct transmission of these forces to motivator 414 may damage delicate parts included therein.

In some embodiments, coupler attachment location 402 may be provided at a position between coupler assembly 104 and motivator 414. Positioning coupler attachment location 402 between motivator 414 and coupler assembly 104 may avoid undesirable electrical disconnections that may result from including the motivator 414 in the portions of self-contained coupler 100 that might swing laterally or vertically during the course of train operation. Moreover, separating motivator 414 and coupler assembly 104 in this way may also protect motivator 414 from slack action as described above.

While the embodiment shown in FIG. 4 illustrates motivator 414 as including servo 418, it will be appreciated that motivator 414 may include any suitable device for generating motion. For example, in some embodiments, motivator 414 may include one or more of a solenoid, a memory wire, and a motor and gear box. Further, while the embodiment shown in FIG. 4 illustrates movable link 416 as including a chain, it will be appreciated that movable link 416 may include any suitable mechanism or structure for transmitting motion from motivator 414 to coupler assembly 104. Non-limiting examples of other structures that may be included in movable link 416 include adjustable-length transmission rods, fixed-length transmission rods, and so on.

Figure 5:
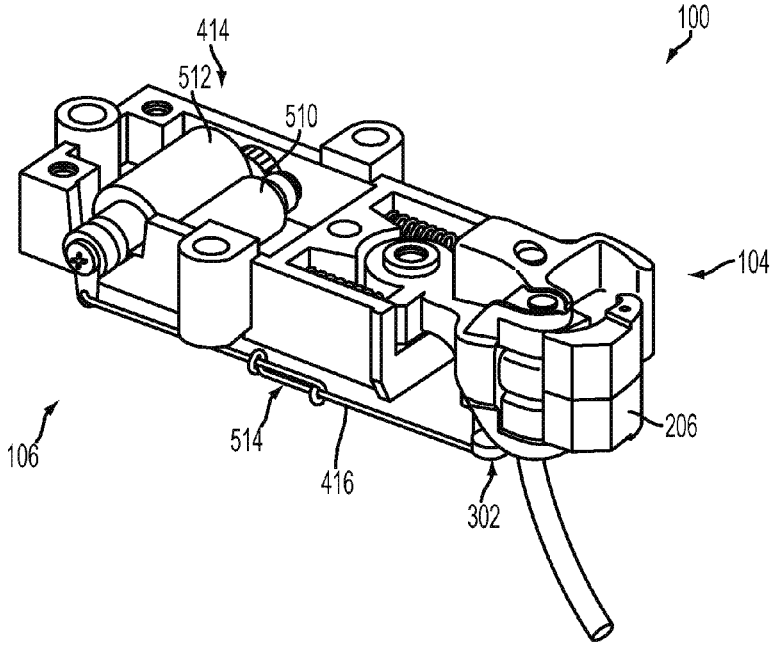
FIG. 5 illustrates an interior portion of another example of a self-contained coupler according to an embodiment of the present disclosure.

For example, FIG. 5 illustrates an interior portion of another example of self-contained coupler 100. The embodiment of motivator 414 shown in FIG. 5 includes a motor 510 and a gearbox 512. Any suitable motor 510 may be employed to drive gearbox 512 without departing from the scope of the present disclosure. For example, a suitable coreless micro motor, which may provide a small form factor adapted for inclusion in motivator 506, may be employed. A suitable piezo motor may be included in another non-limiting example. Likewise, any suitable gear system may be included in gearbox 512 to transmit motion from motor 510 to movable link 416. Non-limiting examples include planetary gear systems, spur gear systems, cycloid drive systems, and harmonic drive systems.

The embodiment of movable link 416 shown in FIG. 5 includes a rigid link, such as a transmission rod. Such rigid links may be employed in settings where motivator 414 drives the coupler from one position to another. Put differently, rigid lengths may be suited for use in embodiments where the motivator adjusts the coupler in both directions. If included, in some embodiments a rigid link may have a variable or adjustable length (shown as a slide adjustment 514 in FIG. 5) so that the coupler will not open as the train travels around a curve. Moreover, including adjustability in a rigid link may permit continued operation of the coupler despite changes in motivator behavior, such as gear wear, servo wear, and so on.

Figure 6:
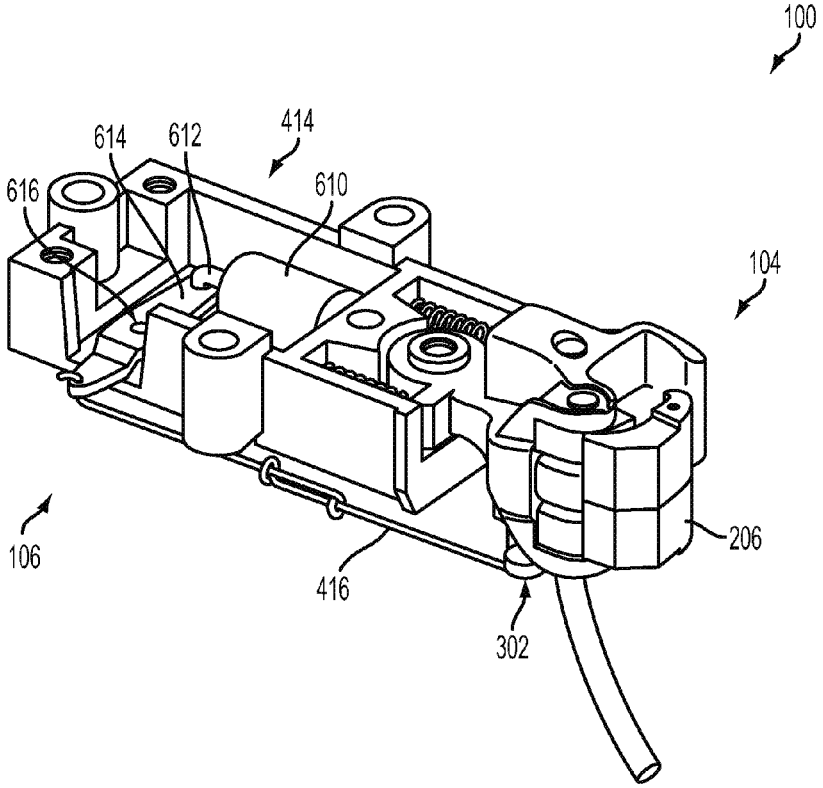
FIG. 6 illustrates an interior portion of another example of a self-contained coupler according to an embodiment of the present disclosure.

As another example, FIG. 6 illustrates an interior portion of another example of self-contained coupler 100. The embodiment of motivator 414 shown in FIG. 6 includes a solenoid 610 including a plunger 612 coupled to a lever 614 that pivots at a pivot location 616. In use, extension of plunger 612 causes coupler assembly 104 to move to a closed position. Retraction of plunger 612 causes coupler assembly 104 to move to an open position.

Figure 7:
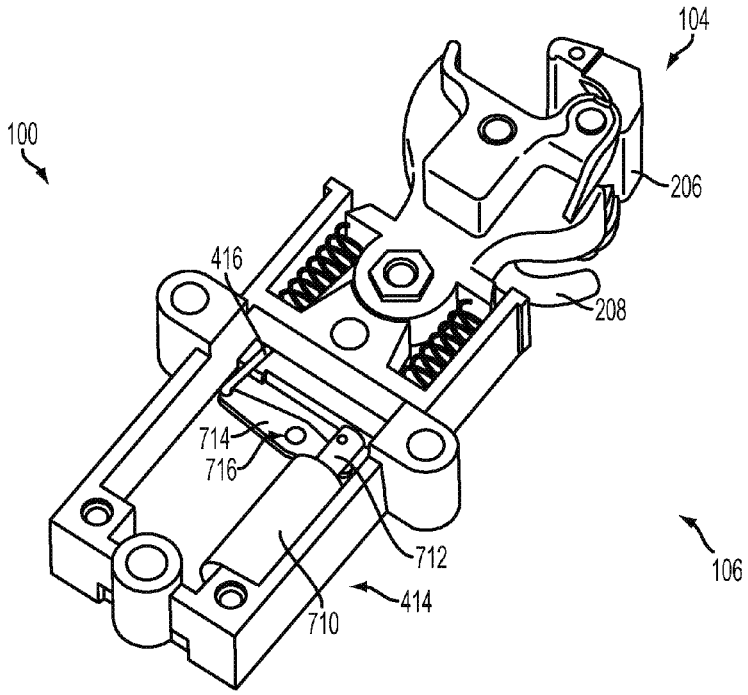
FIG. 7 illustrates an interior portion of another example of a self-contained coupler according to an embodiment of the present disclosure.
Figure 8:
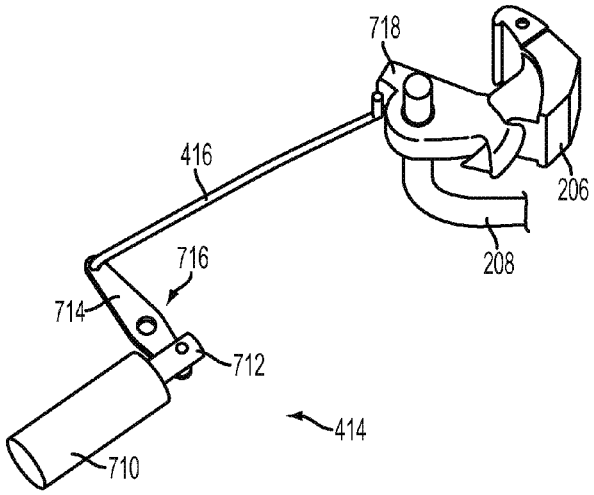
FIG. 8 illustrates a portion of the example self-contained coupler shown in FIG. 7.

As yet another example, FIGS. 7 and 8 illustrate portions of another example of self-contained coupler 100. The embodiment of motivator 414 shown in FIG. 6 includes a solenoid 710 including a plunger 712 coupled to a lever 714 that pivots at a pivot location 716. FIG. 8 shows a portion of the embodiment shown in FIG. 7, where movable link 416, which includes a non-adjustable transmission link, engages with a knuckle stop 718 included in knuckle 206. In use, retraction of plunger 712 causes movable link 416 to push on knuckle stop 718 and in turn causes coupler assembly 104 to move to an open position. Retraction of plunger 712 causes movable link 416 to stop pushing on knuckle stop 718. In turn, coupler assembly 104 moves to a closed position responsive to a bias spring (not shown) included in coupler assembly 104.

As introduced above, some embodiments of the self-contained coupler disclosed herein may be retrofitted to existing rolling stock. The ability to retrofit rolling stock with self-contained couplers may extend a user's enjoyment of the model railroad hobby. However, because some items of rolling stock may have different styles and types of model railroad couplers, it can be difficult to convert a fleet of rolling stock to a common style and be confident of coupler interoperability. Accordingly, some embodiments of the self-contained coupler described herein may be configured so that a modeler may readily retrofit a kit of parts to an existing item of rolling stock.

As introduced above, some model railroad couplers may involve miniaturized application settings. Therefore, installation of some model railroad couplers can be difficult. For example, in some scenarios, a small dimensional tolerance in coupler installation may make the difference between a successful coupling and a frustrating collision. Moreover, it may be difficult to install couplers that include small sub-assemblies, as installation may involve mechanical and/or electrical connections made in constrained spaces with poor visibility.

Accordingly, some of the embodiments disclosed herein may include aspects that are directed toward model railroad couplers that are self-contained. By including small parts and/or connections within an integrated housing, such couplers may be easier to install and maintain. For example, in some embodiments, self-contained coupler 100 may include a housing configured to retain one or more portions of coupler assembly 104 and/or uncoupling assembly 106. In turn, delicate sub-assemblies and/or connections included with the housing may be protected from damage during installation and/or operation. Moreover, such protection may improve the operability of self-contained coupler 100 and its interoperability with other couplers. Further, in some embodiments, self-contained coupler 100 may include one or more mounting locations configured to affix the coupler to rolling stock. Providing a mounting location may speed retrofitting and allow a user to outfit a fleet of rolling stock with ease. For example, such mounting locations may be configured so that, on installation, self-contained coupler 100 is placed into a pre-determined position on the rolling stock. So-positioned, self-contained coupler 100 may be accurately aligned (within an acceptable tolerance) to couple with another coupler.

Figure 9:
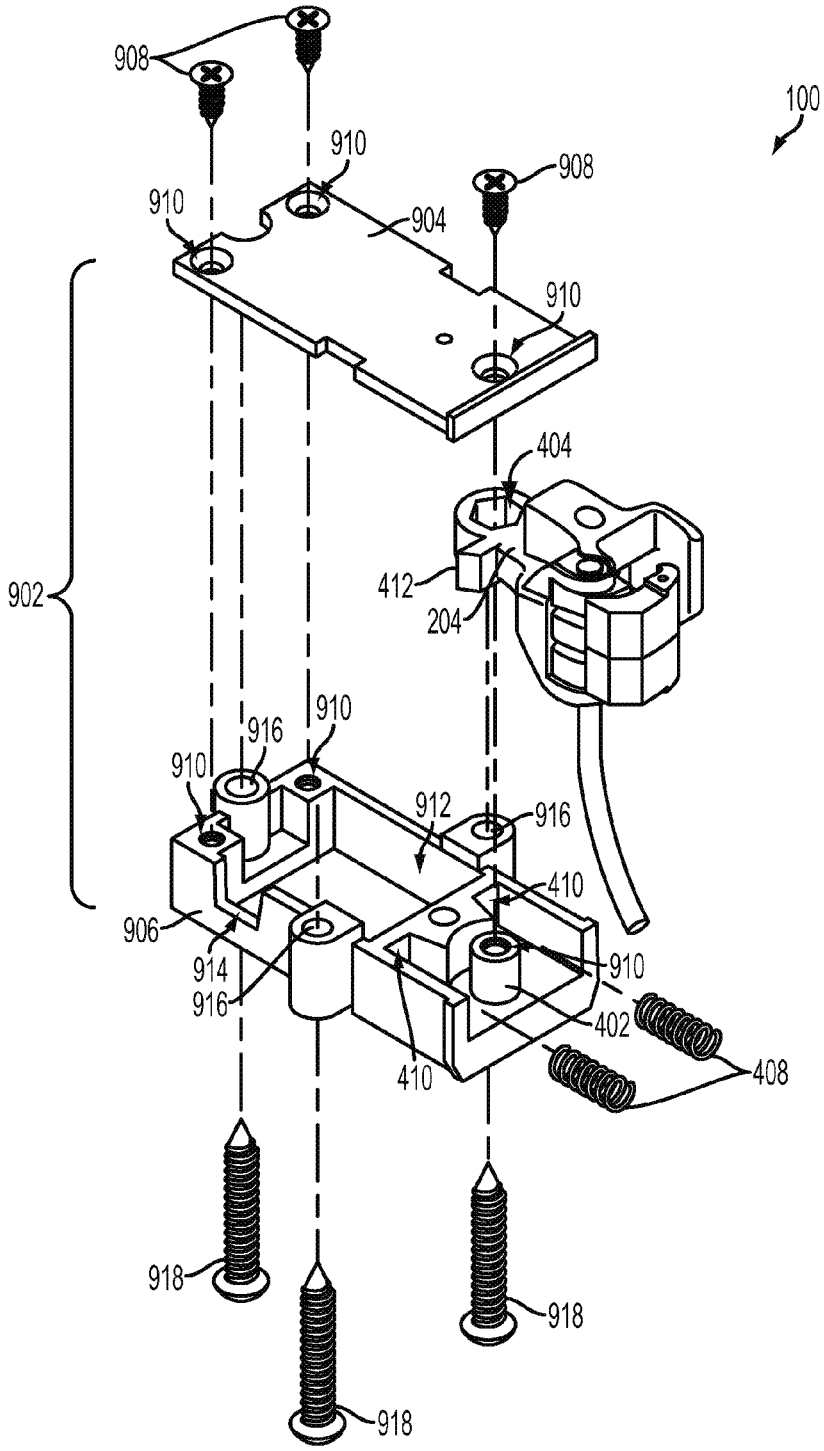
FIG. 9 illustrates an exploded view of an example housing according to an embodiment of the present disclosure.

For example, FIG. 9 illustrates an exploded view of an example housing 902 for use with an embodiment of self-contained coupler 100. As explained in detail below, housing 902 may enclose any suitable portion of self-contained coupler 100. As used herein, "enclose" may include full or partial enclosure or containment of the referenced portions of self-contained coupler 100. Consequently, parts enclosed in housing 902 may be protected from becoming lost and/or from possible damage during train operation. Examples of parts or portions of parts that may be enclosed within housing 902 include, but are not limited to, coupler centering mechanism 406, motivator 414, movable link 416, coupler attachment location 402, shank 204, signal input 210, and rolling stock wireless communicator 108.

The embodiment of housing 902 depicted in FIG. 9 includes a cover 904 and a base 906. In the embodiment shown in FIG. 9, cover 904 is configured to be adjacent to the rolling stock when mounted thereto. In some of such embodiments, a thickness of cover 904 may be selected to set a vertical coupler position on the rolling stock. Additionally or alternatively, in some embodiments, suitable shims or spacers (not shown) may be included to adjust the vertical coupler position.

Cover 904 may be secured to base 906 in any suitable manner. In the embodiment shown in FIG. 9, a plurality of screws 908 removably secure cover 904 to base 906 at a plurality of complementary housing connection locations 910 included in cover 904 and base 906. Additionally or alternatively, in some embodiments, tabs, pins, clips, snaps, or other suitable structures may be used with suitable complementary openings/structures to secure cover 904 to base 906. Alternatively, in some embodiments, cover 904 may be secured to base 906 using a suitable adhesive or weld.

Housing 902 also includes a cavity 912 configured to retain the motivator. The embodiment of housing 902 shown in FIG. 9 includes an optional transmission opening 914 adapted to permit a portion of the motivator and/or the movable link to enter cavity 912. It will be appreciated that the shape and size of cavity 912 may be selected based upon the type of motivator employed. Moreover, cavity 912 may include partitions (not shown) that separate mechanical and/or electrical components held therein. Such measures may avoid chafing and/or provide electrical insulation according to the application.

In some embodiments, housing 902 may be configured to enclose other portions of self-contained coupler 100. For example, in the embodiment depicted in FIG. 9, housing 902 encloses centering springs 408 and coupler attachment location 402. Additionally or alternatively, in some embodiments, housing 902 may enclose the movable link. Enclosing such portions of self-contained coupler 100 may help retain small parts and avoid entry of foreign matter that may interfere with operation of the motivator, the movable link, the coupler centering mechanism, or the like.

Housing 902 also includes one or more locations adapted so that self-contained coupler 100 may be mounted to an item of model railroad rolling stock. For example, the embodiment shown in FIG. 9 depicts a plurality of rolling stock mounting locations 916 through which screws 918 may be inserted to fasten housing 902 to the item of rolling stock. In some embodiments, rolling stock mounting locations 916 may be configured to mate with a complementary pattern of attachment positions pre-located in an item of rolling stock. For example, the pattern may be configured to that the installed coupler is positioned according to a standardized placement for model railroad couplers on rolling stock. This may help align self-contained coupler 100 in a predetermined position on the rolling stock (e.g., within a horizontal plane) so that the coupler will couple with other rolling stock. For example, FIG. 9 shows that rolling stock mounting locations 916 are arranged in a triangular pattern on base 906. A rail car may include a complementary triangular pattern of openings formed thereon. A modeler may install self-contained coupler 100 by aligning rolling stock mounting locations 916 with the complementary openings on the rail car and securing screws 918. Once installed, a modeler may feel confident that self-contained coupler 100 is properly aligned and will couple readily with other items of rolling stock.

Figure 10:
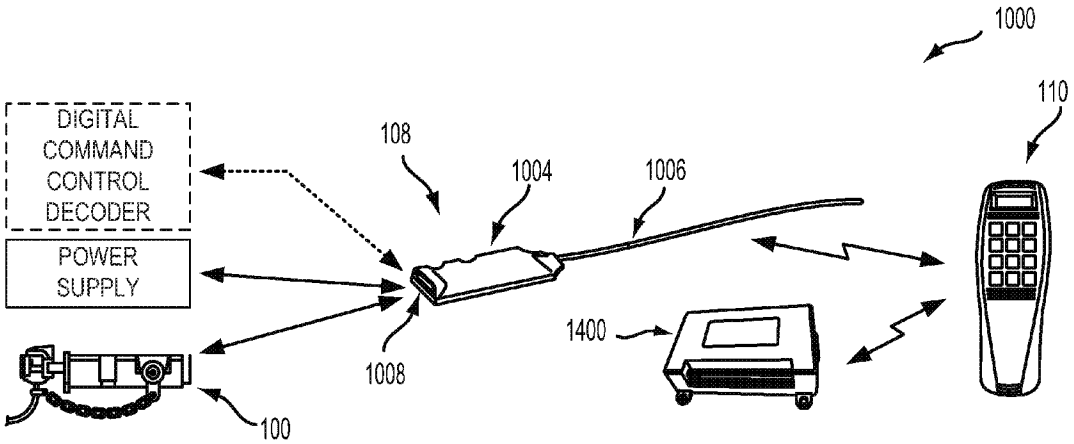
FIG. 10 schematically illustrates an example model railroad rolling stock coupling/uncoupling system according to an embodiment of the present disclosure.

As introduced above, once installed on an item of rolling stock, self-contained coupler 100 may be controlled so that the coupler moves from a coupled position to an uncoupled position and/or an uncoupled position to a coupled position responsive to a signal. For example, FIG. 10 schematically illustrates an embodiment of an example model railroad rolling stock coupling/uncoupling system 1000 that may be used to control operation of self-contained coupler 100 or any suitable model railroad coupler. In the embodiment shown in FIG. 10, rolling stock wireless communicator 108 includes a control module 1004 and an antenna 1006. Antenna 1006 is configured to receive, and in some embodiments, to emit, signals at one or more radio frequencies. In some embodiments, antenna 1006 may receive a radio signal at one or more frequencies within a range of 902 to 928 MHz. Additionally, in some embodiments, antenna 1006 may transmit a radio signal at one or more frequencies within a range of 902 to 928 MHz. It will be appreciated that any suitable material and configuration may be employed for antenna 1006 without departing from the scope of the present disclosure. For example, FIG. 10 depicts antenna 1006 as including a whip antenna, though other shapes, such as coil-shaped or serpentine-shaped antennas may be employed in some embodiments.

Control module 1004 is configured to receive a radio signal from antenna 1006 and send a signal to the coupler via the signal input. In turn, the uncoupling mechanism adjusts a portion of the coupler assembly from a first position to a second position. It will be appreciated that control module 1004 may control coupling/uncoupling action at one or more couplers with which control module 1004 communicates. Further, while the example control module 1004 is shown in FIG. 10 as controlling a coupler, it will be appreciated that other aspects of rolling stock in which rolling stock wireless communicator 108 is included may be controlled using control module 1004 in some embodiments. For example, light, sound, and/or animation effects may be controlled in response to suitable signals received from signal source 110. Further, in some embodiments, control module 1004 may be configured to receive a digital command control (DCC) input from a suitable DCC decoder. In turn, the DCC decoder may provide signals operative to cause control module 1004 to operate one or more couplers in a preselected fashion. Additionally or alternatively, in some embodiments, control module 1004 may be configured to provide input to a suitable DCC decoder and control suitable DCC functions via the decoder. For example, in some embodiments, control module 1004 may provide input to a DCC decoder used to control a model railroad locomotive. Thus, a suitable DCC decoder may operate one or more motors, lights, sounds, or other features of the model railroad locomotive responsive to input supplied by control module 1004.

Control module 1004 supplies/exchanges signals with self-contained coupler 100 via signal input 210. For example, control signals may be supplied from control module 1004 to a motivator included in self-contained coupler 100 via a suitable connection header 1008 in some embodiments. It will be appreciated that any suitable connection header 1008 may be provided without departing from the scope of the present disclosure. For example, in some embodiments, connection header 1008 may include an eleven-pin press-fit connection. In some embodiments, one or more suitable crimp and/or solder connections may be made between control module 1004 and signal input 210 via connection header 1008. In some other embodiments, connection header 1008 may be omitted, and control module 1004 provide signals directly to signal input 210 via one or more suitable connections (e.g. a crimp or solder connection).

In some embodiments, connection header 1008 may also receive power from a power supply and, in some embodiments, provide power to the respective self-contained couplers, potentially saving space within the self-contained coupler. For example, connection header 1008 may include one or more power supply connections configured to receive power from a power supply to power control module 1004 and to supply power to one or more self-contained couplers 100.

It will be appreciated that any suitable power supply may provide power to rolling stock wireless communicator 108 without departing from the scope of the present disclosure. In some embodiments, rolling stock wireless communicator 108 may receive power from an onboard power supply. For example, control module 1004 may receive power from 4 AAA batteries and provide power at 200 mA and 6 V DC to a pair of couplers with which control module 1004 is electrically connected. Additionally or alternatively, in some embodiments, rolling stock wireless communicator may receive power from a power supply located external to the rolling stock. For example, control module 1004 may receive power collected from one or more energized rails of a model railroad layout using a pick-up electrically coupled with control module 1004.

In some embodiments, control module 1004 may be configured to enter a lower power standby state after a preset delay (e.g., as controlled by a suitable programmable relay) or in response to a command received from signal source 110, and then re-enter a higher power active state in response to another command received from signal source 110. Low power operation may preserve power source lifetime, potentially enhancing the user experience while reducing maintenance time.

Figure 11:
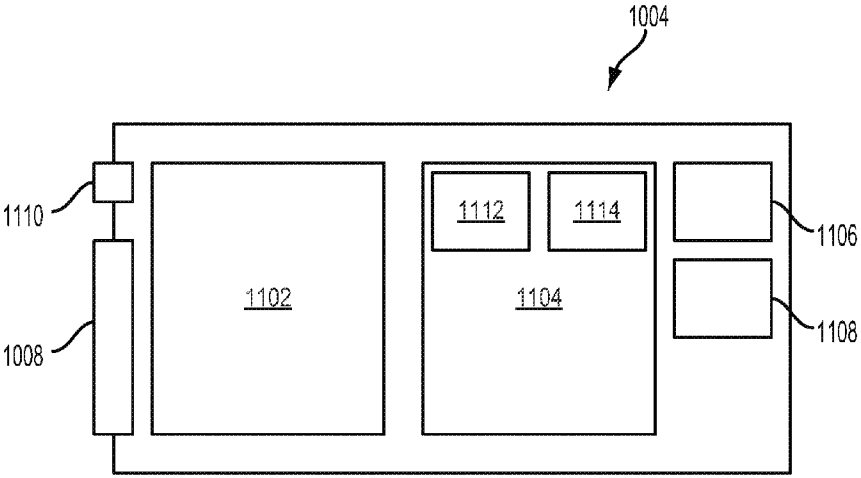
FIG. 11 schematically illustrates an example control module according to an embodiment of the present disclosure.

FIG. 11 schematically illustrates another view of a portion of an example control module 1004. Control module 1004 includes a coupler control subsystem 1102 operative to manage operation of one or more self-contained couplers and a communication module 1104 operative to communicate with the signal source. In the embodiment shown in FIG. 11, control module 1004 includes a processor 1106 operative to execute instructions stored in memory 1108. Such instructions may be executed to control the various processes described herein.

Coupler control subsystem 1102 controls the operation of one or more motivators in respective self-contained couplers communicating with control module 1004. In some embodiments, coupler control subsystem 1102 may include a servo control including servo speed and servo position control. In some embodiments, coupler control subsystem 1102 may include suitable motor control logic and hardware (e.g., pulse width modulation logic and hardware) and may also include sensors and/or logic for determining the position, speed and/or direction of a motor. For example, current feedback sensors and current feedback logic may be employed to determine information about a motor included in a motivator.

In the embodiment shown in FIG. 11, communication module 1104 is operative to receive and, in some embodiments, transmit signals to the signal source using the antenna via antenna connection 1110. In some embodiments, one or more portions of communication module 1104 may be shielded from one or more electromagnetic frequencies with a suitable signal shield. Shielding communication module 1104 may enhance operation by discouraging undesired coupler action resulting from stray radio signals.

In some embodiments, communication module 1104 may include a transceiver 1112. Transceiver 1112 is operative to receive and transmit signals via the antenna. Consequently, rolling stock wireless communicator 108 may confirm that an operation requested by the signal source has been performed and/or provide status updates to the signal source at predetermined intervals. For example, in one scenario, rolling stock wireless communicator 108 may update the signal source about a power supply status (e.g., remaining battery life). In another scenario, rolling stock wireless communicator 108 may transmit a signal to the signal source at a predetermined interval that may allow the signal source to determine whether rolling stock wireless communicator 108 is within a predetermined communication range of the signal source.

In some embodiments, communication module 1104 may include a filter 1114 operative to process signals received via the antenna. In some embodiments, filter 1114 may remove one or more selected signals. Additionally or alternatively, in some embodiments, filter 1114 may enhance one or more selected signals. It will be appreciated that any suitable filter 1114 may be included in communication module 1104 without departing from the scope of the present disclosure. For example, in some embodiments, filter 1114 may include a surface acoustic wave filter.

Figure 12:
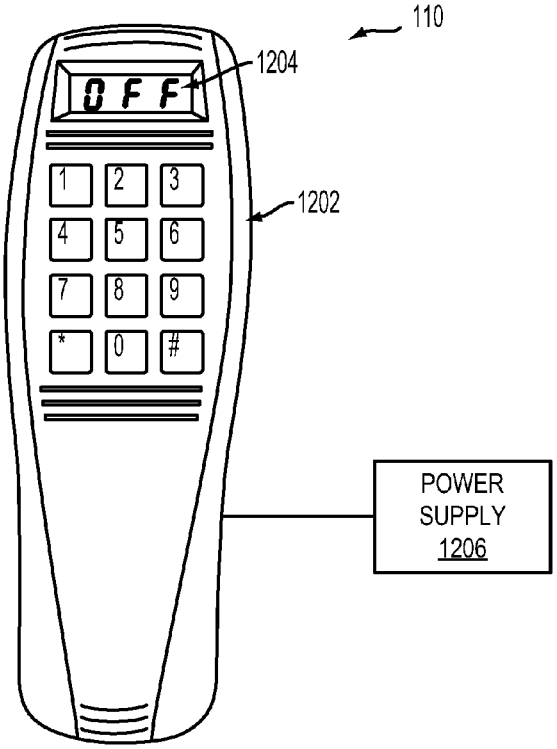
FIG. 12 schematically illustrates an example signal source according to an embodiment of the present disclosure.

FIG. 12 schematically illustrates an embodiment of an example signal source 110. In the embodiment depicted in FIG. 12, signal source 110 appears as a handheld device configured to receive user input and transmit signals. However, it will be appreciated that any suitable configuration for signal source 110 may be employed without departing from the scope of the present disclosure, including console-mounted signal sources and the like.

Signal source 110 includes user input 1202 operative to receive input from a user and a display 1304. In the embodiment shown in FIG. 13, user input 1202 is depicted as a 12-key keypad. However, it will be appreciated that any suitable user input device, include knobs, sliders, and the like may be employed without departing from the scope of the present disclosure. In some embodiments, user input 1202 may be received via suitable elements included in a graphical user input displayed on display 1204. Display 1204 is operative to display information to the user. For example, in some embodiments, display 1204 may indicate coupler status information and/or status information for accessory receivers described in more detail below.

In some embodiments, signal source 110 may be operative to transmit and receive signals to and from selected rolling stock wireless communicator according to an address or other manner of directing a signal to a particular rolling stock wireless communicator. For example, a signal source 110 may be configured to transmit and receive signals from up to 99 rolling stock wireless communicators and/or accessory receivers.

FIG. 12 also shows an example power supply 1206 operatively coupled to signal source 110. In some embodiments, power supply 1206 may be an on-board power supply. In embodiments where signal source 110 is a handheld unit, an on-board power supply may permit a user to transport signal source 110 freely without being tethered to a base station. For example, an on-board power supply may include one or more batteries sharing an enclosure with signal source 110. In some other embodiments, power supply 1206 may be included in a base station (not shown), and signal source 110 may be configured to receive power from the base station via a cable.

As introduced above, in some embodiments, a signal source may also be used to operate various accessory controllers. For example, an accessory controller may be used to operate railroad track turnouts so that a user may select train routing using the signal source. In another example, an accessory controller may be used to control locomotive operation, so that locomotive speed and/or sound effects may be controlled using the signal source. In yet another example, an accessory controller may be used to control animated accessories on a model railroad, such as windmills, waterwheels, and the like.

Figure 13:
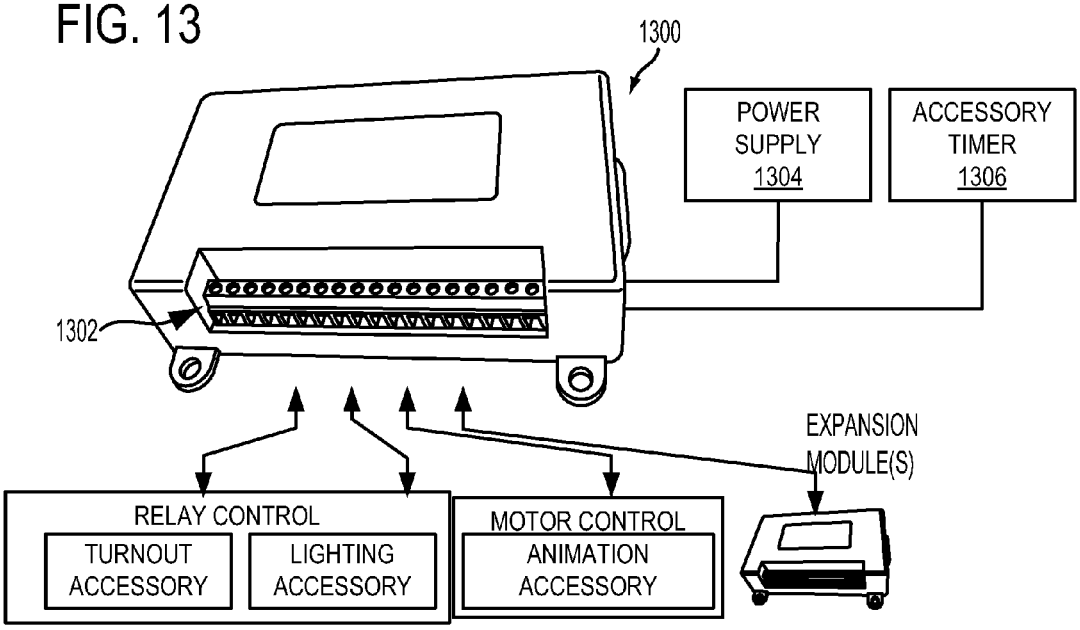
FIG. 13 schematically illustrates an example accessory receiver according to an embodiment of the present disclosure.

FIG. 13 schematically illustrates an embodiment of an accessory controller 1300 operative to control operation of one or more accessories. In the embodiment shown in FIG. 13, accessory controller 1300 includes a connection hub 1302 configured to provide output to and receive input from any suitable accessory and a power source 1304 configured to power accessory controller 1300. It will be appreciated that any suitable power source 1304 may be employed without departing from the scope of the present disclosure. In some embodiments, power source 1304 may include a 12 V DC power source including a plug-in transformer suited for use with household power. In some embodiments, power source 1304 may also provide power to one or more accessories in electrical communication with accessory controller 1300 via connection hub 1402.

In some embodiments, accessory controller 1300 may be configured to operate eight relays at up to 5 A output using one or more relay controllers, though it will be appreciated that some embodiments may be configured to operate more or less than eight relays. In some embodiments, accessory controller 1300 may be configured to operate one or more motorized accessories via a motor controller.

In some embodiments, accessory controller 1300 may be expanded to control any suitable number of accessories of any suitable type by adding expansion modules. For example, in some embodiments, a single accessory controller 1300 configured to control eight relays may be expanded to control 64 relays by connecting seven expansion modules capable of controlling eight relays each to accessory controller 1400.

In some embodiments, accessory operation may be controlled according to any suitable number of preselected groups of accessory actions. For example, in some embodiments, up to ten groups may be triggered concurrently, potentially allowing a user to activate up to 64 accessory actions concurrently.

In some embodiments, accessory operation may be controlled according to preselected time settings. For example, accessory controller 1300 may be programmed to operate an accessory for a preselected time and then turn the accessory off using an accessory timer 1306. For example, a model of a rollercoaster may be operated at preselected intervals to simulate individual trips thereon. As another example, accessory controller 1300 may be programmed to cause groups of accessories to operate in a preselected sequence. In one scenario, groups of lights in a model town may be turned on in sequence to simulate nightfall on the model railroad. As yet another example, an electromagnetic uncoupling ramp may be turned off without user intervention.

While the examples of accessory controller 1300 and rolling stock wireless communicator 108 are described in the context of a model railroad setting, it will be appreciated that any suitable application where wireless remote control of visual, audio, or animation effects may be contemplated without departing from the scope of the present disclosure. For example, a suitable wireless communicator may be coupled with suitable motivators included in a figurine, toy animal, or vehicle to provide wireless remote motion control for such models. Thus, suitable wireless communicators and/or accessory communicators may be employed to control operation of one or more robots and/or robotic effects. Similarly, suitable accessory controllers may be used with light, sound, and animation effects in dollhouses, potentially enhancing the user experience.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. Thus, the various acts illustrated may be performed in the sequence illustrated, in other sequences, or omitted in some cases.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A self-contained coupler for model railroad rolling stock, the self-contained coupler comprising:

a coupler assembly including a knuckle; and an uncoupling assembly configured to operate the coupler assembly, the uncoupling assembly including:

a signal input for receiving a signal, a motivator coupled to the coupler assembly via a movable link, the motivator operative to adjust the knuckle from a first position to a second position responsive to the signal, and a housing including the motivator, a coupler centering mechanism, a coupler attachment location for attaching the coupler assembly to the uncoupling assembly at a position between the knuckle and the motivator, and a rolling stock mounting location for removably affixing the self-contained coupler to a model railroad rolling stock, the model railroad rolling stock including one of a rail car or locomotive.

2. The self-contained coupler of claim 1, where the coupler assembly is pivotally attached to the uncoupling assembly at the coupler attachment location.

3. The self-contained coupler of claim 1, where the housing encloses the motivator and the coupler attachment location.

4. The self-contained coupler of claim 1, where the housing encloses a spring for aligning the coupler assembly in a predetermined lateral alignment.

5. The self-contained coupler of claim 1, where the motivator includes one of a solenoid operative to push the knuckle into an uncoupled position and a solenoid operative to pull the knuckle into an uncoupled position.

6. The self-contained coupler of claim 1, where the motivator includes a memory wire.

7. The self-contained coupler of claim 1, where the motivator includes a servo.

8. The self-contained coupler of claim 1, where the motivator includes a gear box.

9. The self-contained coupler of claim 1, where the coupler assembly includes a magnetically-sensitive trip pin coupled to the knuckle.

10. A self-contained coupler kit for retrofitting an uncoupling mechanism to model railroad rolling stock, the self-contained coupler kit comprising:

a coupler assembly including a knuckle; and an uncoupling assembly including:

a signal input, a motivator operative to adjust the knuckle from a first position to a second position, and a housing including the motivator, a coupler centering mechanism, a rolling stock mounting location for removably affixing the self-contained coupler kit to a model railroad rolling stock, and a coupler attachment location for pivotally mounting the coupler assembly to the uncoupling assembly between the motivator and the knuckle, the model railroad rolling stock including one of a rail car or locomotive.

11. The self-contained coupler kit of claim 10, where the housing encloses the motivator and the coupler attachment location.

12. The self-contained coupler kit of claim 10, where the housing encloses a movable link joining the knuckle and the motivator, the movable link operative to transmit motion from the motivator to the knuckle.

13. The self-contained coupler kit of claim 10, where the housing encloses a spring for aligning the coupler assembly in a predetermined lateral alignment.

14. The self-contained coupler kit of claim 10, where the motivator is selected from the set consisting of a servo, a gear box, a memory wire, and a solenoid.

15. The self-contained coupler kit of claim 10, where the coupler assembly includes a magnetically-sensitive trip pin coupled to the knuckle.

16. A self-contained coupler for model railroad rolling stock, the self-contained coupler comprising:

a coupler assembly contained within the self-contained coupler including:

a knuckle, and a magnetically sensitive trip pin coupled to the knuckle; and an uncoupling assembly contained within the self-contained coupler configured to operate the coupling assembly, the uncoupling assembly including:

signal input for receiving a signal, a motivator coupled to the coupler assembly via a movable link, the motivator operative to adjust the knuckle from a first position to a second position responsive to the signal, and a housing including the motivator, a rolling stock mounting location for removably affixing the self-contained coupler to a model railroad rolling stock, and a spring for aligning the coupler assembly in a predetermined lateral alignment, the model railroad rolling stock including one of a rail car or locomotive, where the housing encloses the motivator and a coupler attachment location for pivotally mounting the coupler assembly to the uncoupling assembly between the motivator and the knuckle.

17. The self-contained coupler of claim 16, where the motivator is selected from the set consisting of a servo, a gear box, a memory wire, and a solenoid.

18. A self-contained coupler for model railroad rolling stock, the self-contained coupler comprising:

a coupler assembly including a knuckle; and an uncoupling assembly configured to operate the coupler assembly, the uncoupling assembly including:

a signal input for receiving a signal, a motivator coupled to the coupler assembly via a movable link, the motivator operative to adjust the knuckle from a first position to a second position responsive to the signal, and a housing including the motivator, a coupler centering mechanism, and a rolling stock mounting location for removably affixing the self-contained coupler to a model railroad rolling stock, the model railroad rolling stock including one of a rail car or locomotive, where the housing encloses the movable link.

19. The self-contained coupler of claim 18, wherein the self-contained coupler is in operative communication with a rolling stock wireless communicator configured to receive wireless communication; and the motivator of the self-contained coupler operative to adjust the coupler assembly from a first position to a second position responsive to a signal received from the rolling stock wireless communicator.

20. The self-contained coupler of claim 19, where the rolling stock wireless communicator includes a transmitter configured to send a confirmation signal to a signal source after adjusting the coupler assembly from the first position to the second position.

21. The self-contained coupler of claim 18, where the housing of the uncoupling assembly includes:

the motivator, the rolling stock mounting location for mounting the self-contained coupler to an item of model railroad rolling stock, and a coupler attachment location for pivotally mounting the coupler assembly to the uncoupling assembly between the motivator and the knuckle.

* * * * *